US005092698A

United States Patent [19]

Narui et al.

[11] Patent Number: 5,092,698

[45] Date of Patent: Mar. 3, 1992

[54] PLATEN ROLLER APPARATUS

[75] Inventors: Youichi Narui; Seiji Okunomiya, both of Katsuta; Masami Takada, Ibaraki, all of Japan

[73] Assignee: Hitachi, Ltd., Tokyo, Japan

[21] Appl. No.: 510,200

[22] Filed: Apr. 17, 1990

[30] Foreign Application Priority Data

Apr. 26, 1989 [JP] Japan ..... 1-104406

[51] Int. Cl.[5] ..... B41J 11/00

[52] U.S. Cl. ..... 400/649; 400/645.4; 101/409; 271/277

[58] Field of Search ..... 400/610.1, 610.2, 625, 400/649, 659, 645.4; 101/409; 271/82, 277

[56] References Cited

U.S. PATENT DOCUMENTS

| | | | |
|---|---|---|---|
| 3,937,142 | 2/1976 | Cerny et al. | 101/409 |
| 4,072,306 | 2/1978 | Idstein | 271/82 |
| 4,259,695 | 3/1981 | Nakano | 271/277 |
| 4,500,219 | 2/1985 | Lange et al. | 400/645 |
| 4,594,597 | 6/1986 | Liu et al. | 400/625 |
| 4,627,754 | 12/1986 | Sholtis et al. | 400/649 |
| 4,852,488 | 8/1989 | Abendroth et al. | 101/409 |
| 4,891,655 | 1/1990 | Watanabe | 400/649 |
| 4,903,598 | 2/1990 | Kobayashi et al. | 101/409 |
| 4,905,985 | 3/1990 | Nagatani | 101/409 |
| 4,949,638 | 8/1990 | Watanabe | 400/185 |

FOREIGN PATENT DOCUMENTS

| | | |
|---|---|---|
| 629975 | 1/1987 | Japan . |
| 209861 | 8/1988 | Japan . |
| 198551 | 12/1988 | Japan . |

*Primary Examiner*—Edgar S. Burr
*Assistant Examiner*—Ren Yan
*Attorney, Agent, or Firm*—Antonelli, Terry, Stout & Kraus

[57] ABSTRACT

A platen roller apparatus having a cylindrical platen roller, a recording sheet retaining member capable of moving while being maintained in parallel with the axis of the platen roller, a positioning member for positioning a recording sheet on the platen roller; and members for urging the recording sheet retaining member inwardly in the radial direction of the platen roller. The recording sheet is retained while being pinched between the outer circumferential surface of the platen roller and the recording sheet retaining member.

2 Claims, 10 Drawing Sheets

PLATEN ROLLER APPARATUS

BACKGROUND OF THE INVENTION

This invention relates generally to thermal transfer recording apparatus and, more particularly, to a platen roller apparatus for a thermal transfer recording apparatus using a sheet of recording paper.

Japanese Utility Model No. 63-198551 discloses a platen roller of a conventional thermal transfer recording apparatus.

A recording sheet positioning mechanism of the conventional recording apparatus will be described below with reference to FIGS. 15 and 16 of the accompanying drawings.

A cylindrical platen roller 1A has a cut-out outer peripheral portion 1B disposed in parallel to a longitudinal center axis of a rotary platen shaft 2A. An integrally formed recording sheet fixing member 5A is provided on the platen roller 1A so as to be rotatable on rotational supporting points 1C on axial-end surfaces of the platen roller 1A. The recording sheet fixing member 5A serves to retain one end of a recording sheet 3A wound around the platen roller 1A by pressing the end of the sheet against the cut-out portion 1B in a direction toward the platen shaft 2A. Springs 6A are stretched between the recording sheet fixing member 5A and the platen roller 1A to provide a rotational force for retaining the recording sheet 3A. The recording sheet fixing member 5A has a positioning portion 5B for positioning the recording sheet 3A which is supplied to the gap between the cut-out portion 1B of the platen roller 1A and the recording sheet fixing member 5A.

FIG. 17 also shows another conventional roller of a similar type.

SUMMARY OF THE INVENTION

It is an object of the present invention to provide a platen roller apparatus which enables the use of a cylindrical platen roller having an outer circumferential surface defined by a complete circle without having any cut-out portion, which can be easily manufactured while determining the outer circumferential size of the platen roller with improved accuracy, and which has a simplified recording paper fixing/positioning mechanism.

To this end, according to the present invention, there is provided a platen roller apparatus including a cylindrical platen roller with a recording sheet retaining member being capable of moving while being maintained in parallel with a longitudinal center axis of the platen roller. A positioning member positions a recording sheet on the platen roller, and a means urge the recording sheet retaining member inwardly in the radial direction of the platen roller. The recording sheet is retained while being pinched between an outer circumferential surface of the platen roller and the recording sheet retaining member.

It is effective to attach the positioning member to opposite side portions of the platen roller.

DESCRIPTION OF THE PREFERRED EMBODIMENT

FIGS. 1 to 4 show the structure of a platen roller apparatus of a thermal transfer recording apparatus around which a recording sheet is adapted to be wound.

Figure 1:
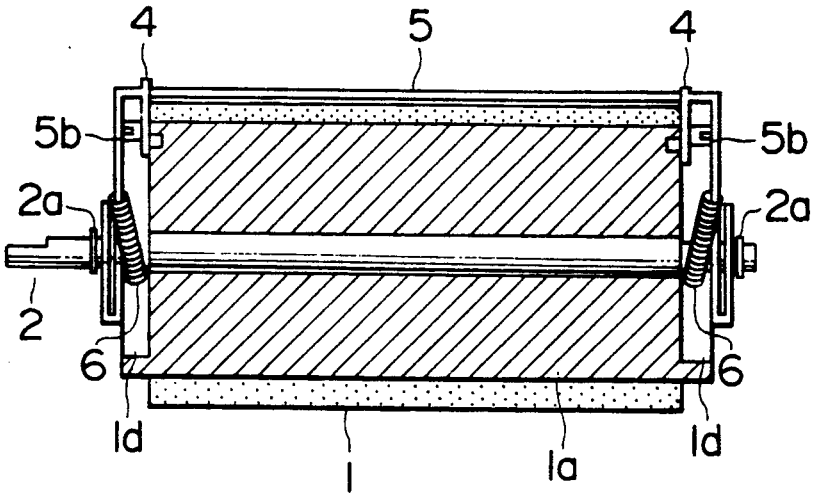
FIG. 1 is a cross sectional view of an embodiment of a platen roller in accordance with the present invention.
Figure 2:
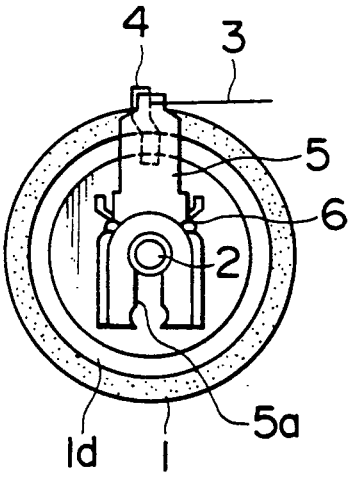
FIG. 2 is a side view of the embodiment in accordance with the present invention.
Figure 3A:
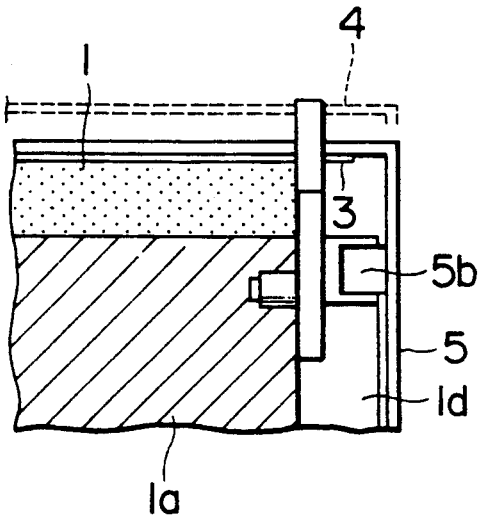
FIG. 3A is a partial cross sectional view of the embodiment in accordance with the present invention.
Figure 3B:
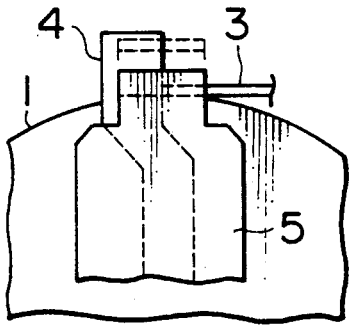
FIG. 3B is a partial side view of the embodiment in accordance with the present invention.
Figure 4:
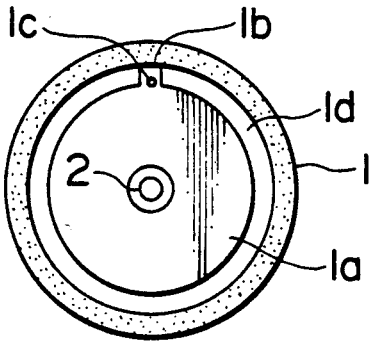
FIG. 4 is a side view of the platen roller of the embodiment in accordance with the present invention.

Referring first to FIGS. 1 and 2, a platen roller 1 includes a rubber member wrapped around and fixed to a cylindrical core 1*a* to form a cylindrical roller surface, and a rotary shaft 2 fixed in the core 1*a*. Circular projecting ribs 1*d* are formed on axial-end surfaces of the cylindrical core 1*a*. Each rib 1*d* has a cut-out portion 1*b* extending in the radial direction of the platen roller 1 (FIG. 4). A press-fitting hole 1*c* is formed in each of the axial-end surfaces of the cylindrical core 1*a* at the cut-out portion 1*b* so as to extend in the axial direction of the platen roller 1 to a certain depth. A pair of stoppers 4 for a recording sheet positioning member have their portions press-fitted in the press-fitting holes 1*c* to be fixed to the cylindrical core 1*a* while contacting axial-end surfaces of the platen roller 1. One end of each stopper 4 extends outwardly in the radial direction of the platen roller 1 so as to protrude beyond the platen roller 1 and is mounted on each side face of the platen roller opposite to each other. The stoppers 4 are spaced apart from each other by a distance less than the width of the recording sheet 3. A chuck arm 5 serves as the recording sheet fixing member which presses an end portion of the recording sheet 3 from the upper side of the same against the outer circumferential surface of the platen roller 1, with this recording sheet portion being suitably positioned on the platen surface. Side portions of the chuck arm 5 facing the axial-end surfaces of the platen roller 1 have grooves 5*a* in which the shaft 2 is fitted (FIG. 2), and projections 5*b* fitted in the cut-out portions 1*b* (FIG. 1). U-shaped springs 6 are attached at their opposite ends to the chuck arm 5, with the shaft 2 being disposed in the U-shaped springs 6. Referring to FIG. 3, the chuck arm 5 is movable relative to the platen roller 1 in the radial direction thereof. Projections 2*a* are formed on opposite end portions of the shaft 2 to prevent the chuck arm 5 from coming off the shaft 2.

Figure 5:
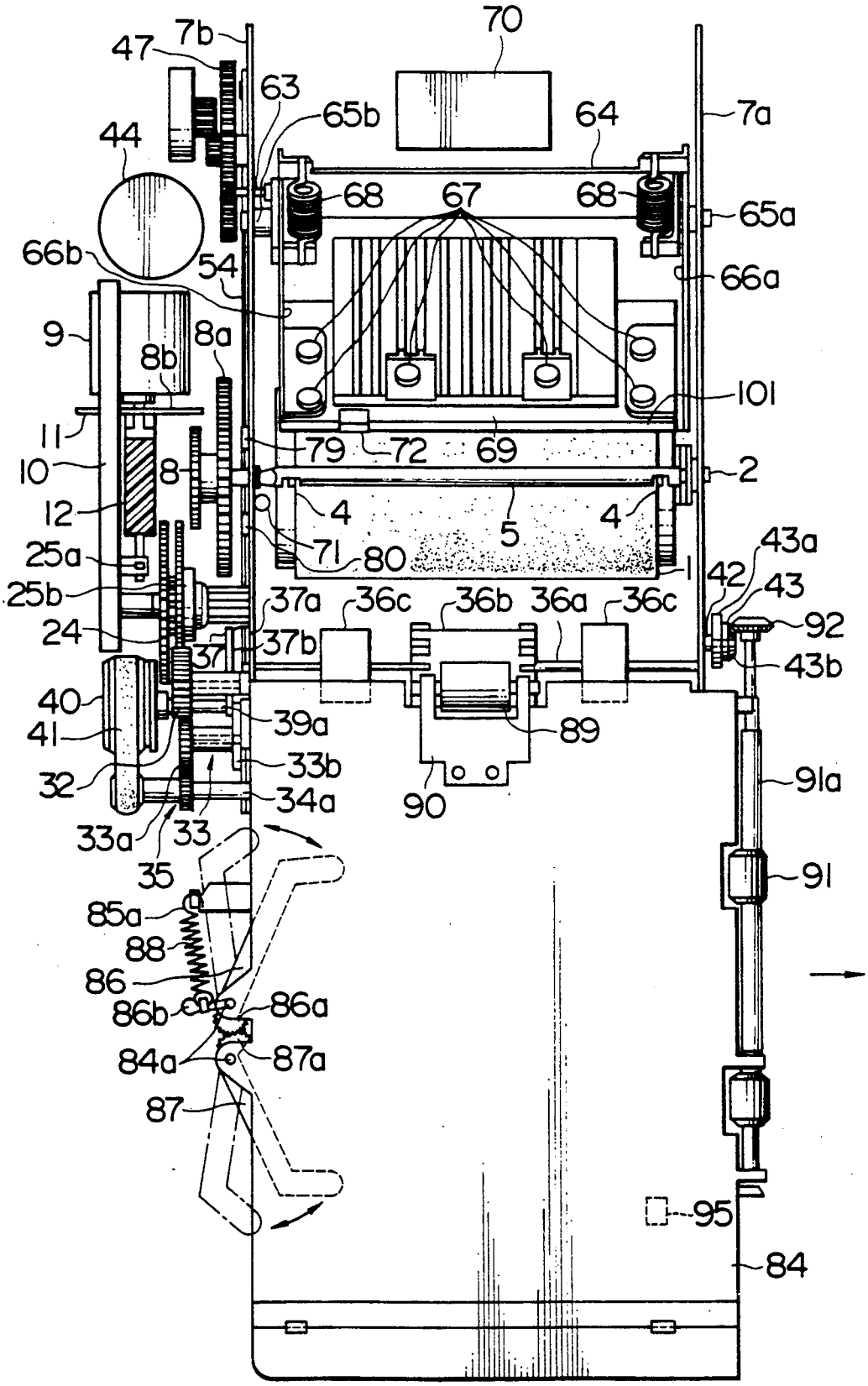
FIG. 5 is a schematic top view of an embodiment of a thermal transfer recording apparatus in accordance with the present invention.

As shown in FIG. 5, the platen roller 1 is supported between chassis 7*a* and 7*b* so as to be rotatable on the shaft 2, and a torque transmitting platen gear 8 including a two-stage gear including a large gear 8*a* and a small gear 8*b*, is fixed to one end of the shaft 2. A motor 9, serving as a drive source for the rotation system, is fixed by claws 10*a* on a sub chassis 10 attached to the chassis 7*b*. A slit plate 11 having slits disposed at equal intervals is attached to the rotary shaft of the motor 9, and a sensor 13 (FIG. 6) is attached to the sub chassis 10. A drive circuit (not shown) controls the rotational speed of the motor 9 by detecting the rotational speed with the sensor 13. The slit plate 11 and a worm gear 12 are connected to each other to enable transmission of the torque of the motor 9.

Figure 6:
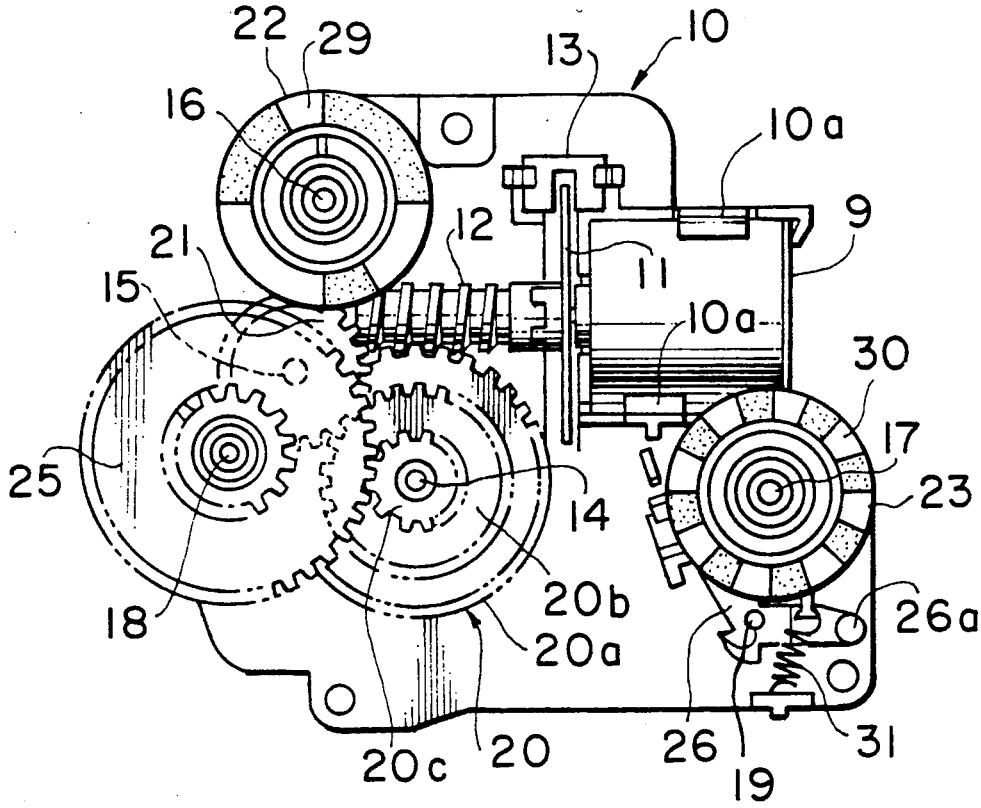
FIG. 6 is a front view of an embodiment of a gear block of rotary drive system of the thermal transfer recording apparatus shown in FIG. 5.
Figure 8:
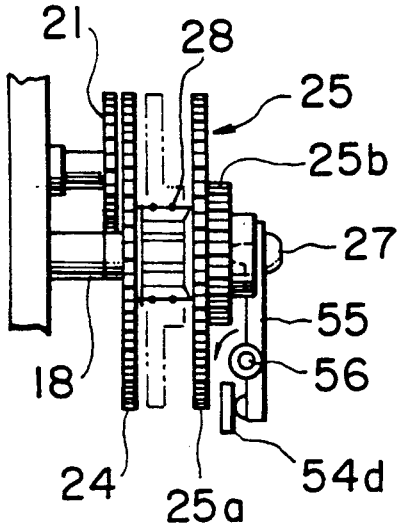
FIG. 8 is a side view of a changeover gear of the recording apparatus shown in FIG. 5.

Referring to FIG. 6, shafts 14 to 19 are rotatably mounted on the sub chassis 10, and a worm wheel gear 20, a first intermediate gear 21, an ink sheet take-up reel base 22, an ink sheet supply reel base 23, a changeover gear 24 are rotatably attached to the shafts 14 to 18, respectively, while a lock arm 26 is swingably attached to the shaft 19. The worm wheel gear 20 includes a three-stage gear including a large gear 20*a*, a medium gear 20*b* and a small gear 20*c*. The large gear 20*b* meshes with the worm gear 12, and the medium gear 20*b* meshes with the first intermediate gear 21 to transmit a driving torque of the worm wheel gear 20 to the ink sheet take-up reel base 22. The small gear 20*c* meshes with the changeover gear 24 to transmit a torque (FIG. 8). Referring to FIG. 8, a slide gear 25 is fitted to the changeover gear 24 with a spring 28 interposed therebetween. The axes of rotation of the slide gear 25 and the changeover gear 2 are aligned with each other. The slide gear 25 is slidable in the axial direction and is capable of always simultaneously rotating with the changeover gear 24. The slide gear 25 includes a two-stage gear including of a large gear 25*a* and a small gear 25*b* which respectively mesh with the large gear 8*a* and the small gear 8*b* of the platen gear 8. A latch member 27 for latching the slide gear 25 urged by the spring 28 is fixed to an end of the shaft 18.

Figure 7:
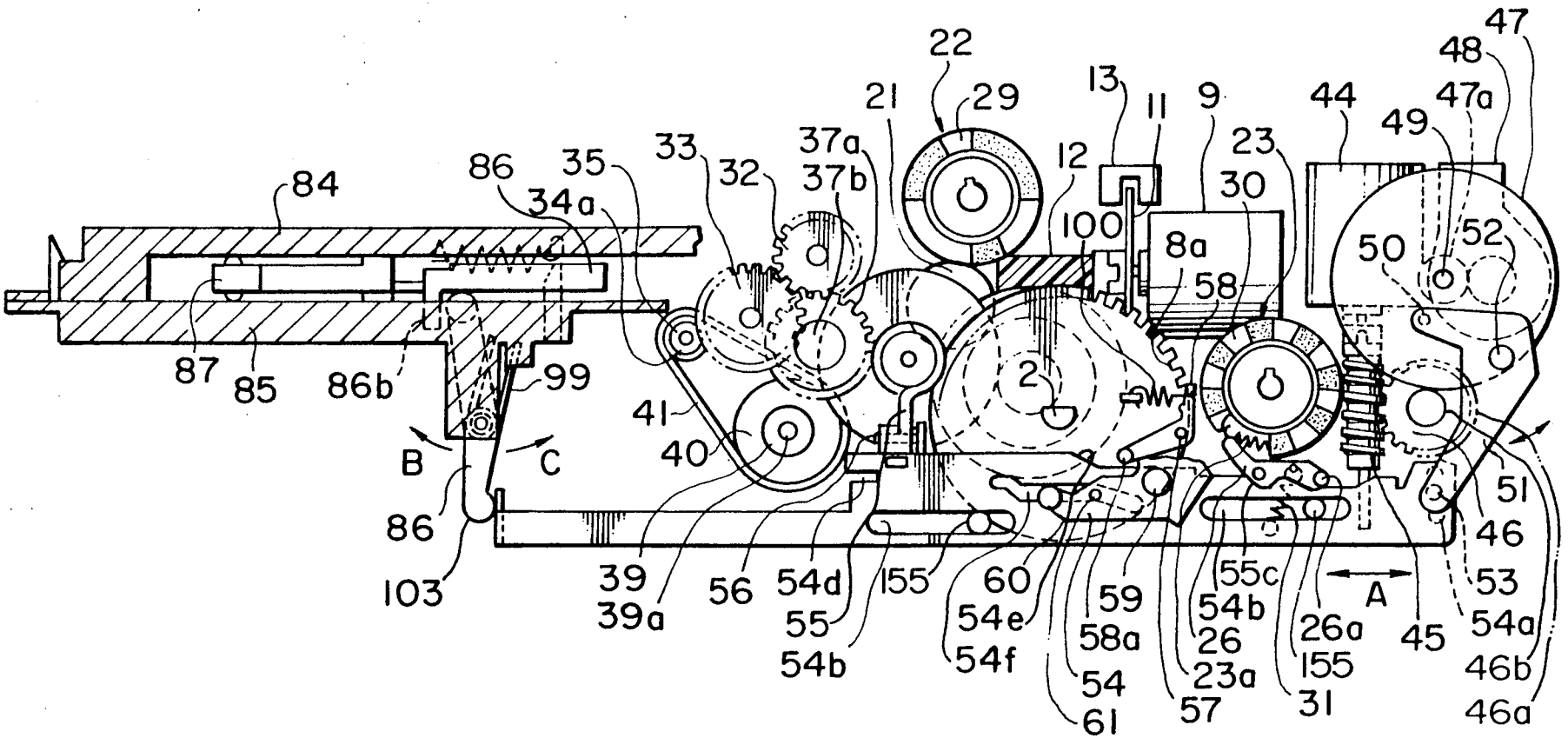
FIG. 7 is a front view of an embodiment of a drive system of the recording apparatus shown in FIG. 5.

Referring to FIG. 7, the ink sheet take-up reel base 22 is driven by a certain friction torque produced by its internal slip mechanism (not shown) from the driving torque transmitted from the first intermediate gear 21. A reflecting plate 29, having large, medium and small pattern pitches for discriminating the direction of the ink sheet take-up reel base 22 with a sensor (not shown), is attached to the take-up reel base 22. An internal slip mechanism (not shown) of the ink sheet supply reel base 23 produces a certain braking torque. A reflecting plate 30, having equal pitch patterns for discriminating whether the ink sheet supply reel base 23, is rotatably attached to the supply reel base 23. The friction torque of the ink sheet supply reel base 23 is set so as to be less than that of the ink sheet take-up reel base 22. The lock arm 26 engages with a ratchet member 23*a* fixed to the ink sheet supply reel base 22, and a lock spring 31 is stretched between the lock arm 26 and the sub chassis 10. As the slide gear 25 is moved toward the changeover gear 24, the large gear 25*a* meshes with a second intermediate gear 32 rotatably attached to a shaft (not shown) attached to the chassis 7*b*. The second intermediate gear 32 meshes with a first gear 33*a* of a two-stage gear 33 provided in a similar manner.

Figure 9:
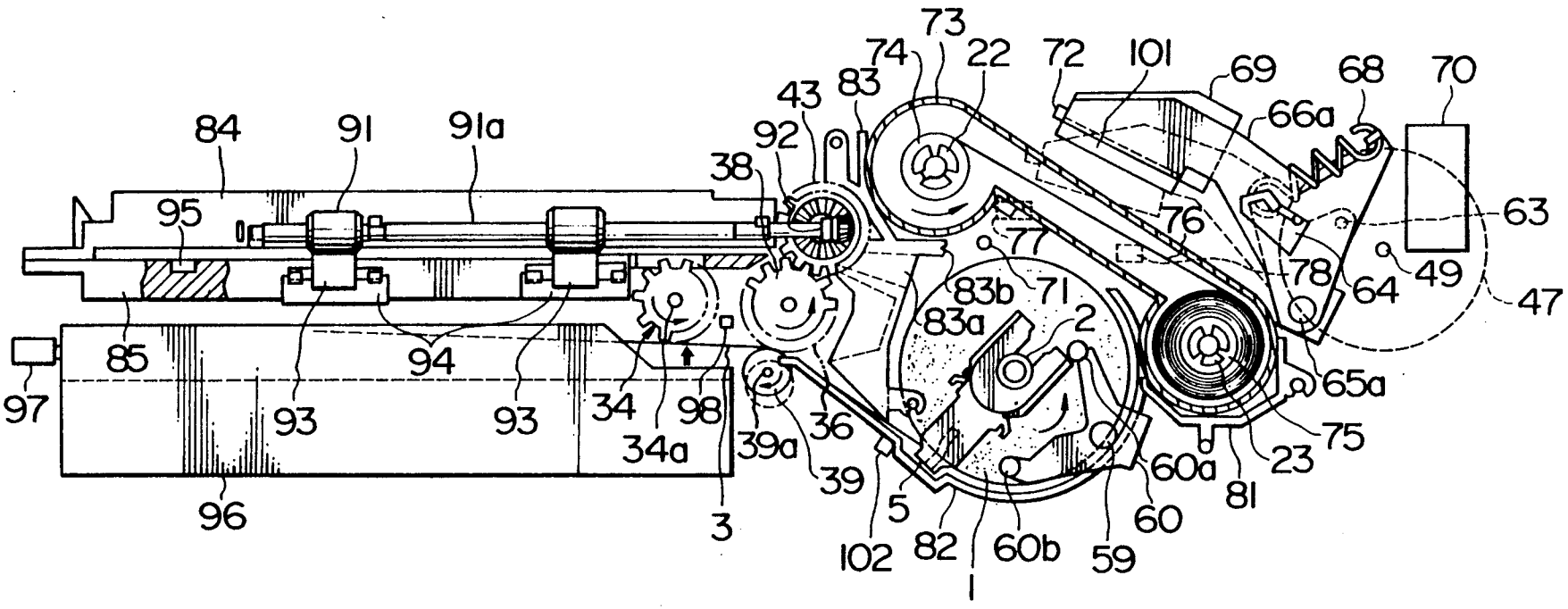
FIG. 9 is a front view of the recording apparatus shown in FIG. 5, illustrating a sheet supply state.

Referring to FIG. 9, a pickup roller 34 having a shaft 34*a* and a rubber member having outer circumferential projections or grooves and fixed on the shaft 34*a*, is axially and rotatably supported between the chassis 7*a* and 7*b*, and a pulley gear 35 for receiving a driving torque is fixed to an end of the shaft 34*a* (FIG. 7). Referring back to FIG. 5, a feed roller 36 has a shaft 36*a*, a cylindrical rubber roller member 36*b* attached to a central portion of the shaft 36*a*, and a pair of cylindrical rubber members 36*c* attached to the shaft 36*a* on the opposite sides of the rubber roller 36*b*. The shaft 36*a* is rotatably supported between the chassis 7*a* and 7*b*. A feed gear 37 which includes a two-stage gear including a large gear 37*a* and a small gear 37*b* for receiving a driving torque is attached to one end of the shaft 36*a*. A sheet discharge gear 38 for transmitting a driving force is attached to the other end of the shaft 36*a*. A separation roller 39 has a shaft 39*a* and a cylindrical rubber member fixed on the shaft 39*a* at a position such that the cylindrical member can contact the cylindrical rubber member 36*c* of the feed roller 36 (FIG. 5). The separation roller 39 is axially and rotatably supported and can be moved to a position indicated by the broken line in FIG. 9. A coupling 40 which transmits a certain torque through its internal slip mechanism (not shown) is constructed on one end of the shaft 39*a*.

Referring again to FIG. 5, the first gear 33*a* of the two-stage gear 33 meshes with the pulley gear 35, and the pulley gear 35 transmits a driving torque to the coupling 40 through a rubber belt 41. A second gear 33*b* of the two-stage gear 33 meshes with the small gear 37*b* of the feed gear 37 to rotate the feed roller 36. The large gear 37*a* of the feed gear 37 is capable of meshing with the small gear 25*b* of the slide gear 25 when the slide gear 25 is moved toward the chassis 7*b*. The sheet discharge gear 38 meshes with a spur gear 43*a* of a third intermediate gear 43 which is rotatably attached to a shaft 42 provided on the chassis 7*a*. The third intermediate gear 43 includes a two-stage gear including the spur gear 43*a* and a bevel gear 43*b*.

Referring to FIG. 7, a second motor 44 for changing over the operating position of the recording apparatus has a rotary shaft to which a worm gear 45 is connected to transmit the torque of the motor. The worm gear 45 meshes with a large gear 46*a* of a speed reduction gear 46 rotatably attached to a shaft (not shown), and a driving force is transmitted through a small gear 46*b* to a cam gear 47 for determining the operating position of the recording apparatus. The cam gear 47 is rotatably attached to a shaft 49 provided on the chassis 7*b*. The cam gear 47 has a small gear 47*a* which engages with a rotary changeover switch 48.

The changeover switch 48 is connected to a circuit (not shown) for driving the second motor 44. The rotation of the motor 44 based on driving in each of operating modes is stopped when the changeover switch 48 is changed over by a statement signal in accordance with a designated position.

The second motor 44, the reduction gear 46 and the changeover switch 48 are mounted on a bracket (not shown) which is supported on the chassis 7*b*.

First and second grooves (not shown) are formed on a surface of the cam gear 47. A pin 50 fitted in the first groove is provided on an arm 51 which is mounted on the chassis *7b* so as to be rotatable on a supporting point 52, and which has a pin 53 provided at a position such as to magnify the movement of the pin 50. The pin 53 is fitted in an elongated hole 54*a* formed in a slider 54 for effecting changeover operation of the recording apparatus. The slider 54 is movable on the chassis *7b* in the directions of the arrows A shown in FIG. 7 with its guide groove 54*b* fitted to a guide shaft 155 provided on the chassis *7b*. The slider 54 has a concave-convex portion 54*c* capable of contacting a cylindrical projection 26*a* of the lock arm 26 to rotate the lock arm 26. Shafts 56 and 57 are provided on the chassis *7b*, and a changeover arm 55 and a platen lock arm 28 are swingably attached to the shafts 56 and 57, respectively. The changeover arm 55 is capable of contacting the slide gear 25 at its one end and swinging in the direction of the shaft 18 (FIG. 8) and is also capable of contacting a concave-convex portion 54*d* of the slider 54 to determine the necessary extent of moving of the slide gear 25 for swinging of the changeover arm.

Referring to FIG. 7, the platen lock arm 58 has a protrusion which is formed at its one end for engagement with a root portion of teeth of the large gear 8*a*, and with is urged toward the large gear 8*a* by a platen lock spring 100 stretched between the platen lock arm 58 and the chassis *7b*. The platen lock arm 58 has a cylindrical projection 58*a* formed at the other end for contact with a concave-convex portion 54*e* of the slider 54.

A K arm 60 for driving the chuck arm 5 is mounted between the chassis *7a* and *7b* so as to be rotatable on a supporting point 59. The K arm 60 has a pin 61 fitted to a hole 54*f* for swinging formed in the slider 54. Each of ends 60*a* and 60*b* of the K arm 60 contacts the chuck arm 5 to cancel the pressing force of the chuck arm 5 according to the position at which the chuck arm is stopped.

Referring to FIG. 5, a rotary shaft 65*b* rotatably passing through a drive arm 64 to which a bead pin 63 fitted in the second groove of the cam gear 47 is attached to a head arm 66*b*, while a rotary shaft 65*a* rotatably passes through a head arm 66*a* and is attached to the drive arm 64. The rotary shafts 65*a* and 65*b* are axially and rotatably supported between the chassis *7a* and *7b*. A thermal head 101 is fixed to the head arms 66*a* and 66*b* with screws 67. A heat sink plate 69 is fixed on the thermal head 101 with screws 67. A fan 70 for cooling the thermal head 101 is fixed between the chassis *7a* and *7b* by a bracket (not shown).

Head springs 68, pressing the thermal head 101 against the platen roller 1 by a certain force, are stretched between the head arms 66*a* and 66*b* and the drive arm 64. To cancel the force of pressing the thermal head 101, portions of the drive arm 64 are brought into contact with the head arms 66*a* and 66*b*.

Referring yet to FIG. 5, a light emitting element 71 emits light having a certain wavelength, with a light receiving element 72 receiving the light from the light emitting element 71, which is mounted at the top end of the thermal head 101. Light emitted from the light emitting element 71 passes through an ink sheet 76 wound around a take-up reel 74 and a supply reel 75 provided in an ink sheet cartridge 73.

The ink sheet 76 has a base film whose surface is successively coated with inks of three colors in turn: yellow, magenta and cyan (not shown). Each of the yellow ink and the magenta ink allows transmission of light from the light emitting element 71 while the cyan ink inhibits transmission of the light.

When the ink sheet cartridge 73 is fitted in the recording apparatus, the take-up reel 74 and the supply reel 75 are respectively brought into engagement with or rotatably connected to the ink sheet take-up reel base 22 and the ink sheet supply reel base 23 through holes (not shown) formed in the ink sheet cartridge 73. Switches 77 and 78 capable of detecting the configuration of the ink sheet cartridge 73 are provided to discriminate the whether or not the ink cartridge is set in the recording apparatus. The characteristics of the ink sheet 76 in the ink cartridge 73 may be changed. In such a case, the configuration of the cartridge is partially changed, and this change is detected by the switches 77 and 78, thereby enabling a control circuit (not shown) to select printing conditions suitable for the ink sheet characteristics.

Sensors 79, 78 detect the position of the platen roller 1, with the sensors 79 and 78 being disposed so as to detect detection points (not shown) set on the platen gear 8.

A guide member 81 is provided at a position corresponding to the supply side of the ink sheet cartridge 73 set in the recording apparatus. The guide member 81 is shaped so as to partly guide the recording sheet 3 along the outer circumference of the platen roller 1.

A guide member 82 for transportation of the recording sheet 3 is provided. A sensor 102 for discriminating the completion of transportation of the recording sheet 3 is attached to the guide 82 upstream of the position at which the recording sheet 3 contacts the stoppers 4 at the time of sheet supply.

A guide member 83 is provided on the take-up side of the ink sheet cartridge 73. The guide member 83 has a discharge opening 83*a* through which the recording sheet 3 is discharged, and a guide portion for guiding the recording sheet 3 supplied and transported along the platen 1. The guide member 83 also has an engagement portion 83*b* at which the take-up-side guide 83 which is brought into engagement with the chuck arm 5 when the chuck arm 5 is lifted from the platen roller 1 at the time of discharge of the recording sheet 3. The supply-side guide member 81, the transportation guide member 82 and the take-up-side guide member 83 are disposed and fixed between the chassis *7a* and *7b*.

Referring to FIG. 7, a combination of associated upper and lower guide members 84 and 85 for guiding the discharged recording sheet 3 is provided between the chassis *7a* and *7b*. A shaft 110 is provided on the lower guide member 85 on which a sheet discharge swinging arm 103 is swingable, with the swinging arm 103 being capable of contacting the slider 54. A torsion spring 99 is provided between a sheet discharge swinging arm 103 and the lower guide member 85 to bias the sheet discharge swinging arm 103. Referring to FIG. 5, a pair of swinging arms 86 and 87 for changing the direction in which the recording sheet 3 is discharged are provided between the upper and lower guide members 84 and 85. The swinging arms 86 and 87 are rotatably fitted in holes 84*a* formed in the upper guide member 84 and in holes (not shown) formed in the lower guide member 85 so as to face the holes 84*a*, while gear portions 86*a* and 87*a* of the swinging arms 86 and 87 are in meshing engagement with each other.

The swinging arm 86 has a cylindrical portion 86*b* capable of contacting the sheet discharge swinging arm 103, and an arm spring 88 is stretched between the cylindrical portion 86*b* and a hook 85*a* provided on the lower guide member 85.

A spring member 90 for applying a force to a roller 89 to bring the same into contact with the central roller member 36*b* of the feed roller 36 is fixed on the upper guide member 84. A shaft 91*a* of a discharge roller 91 for discharging the recording sheet 3 out of the recording apparatus is also rotatably mounted on the upper guide member. A gear 92 is fixed to one end of the shaft 91*a*, which gear meshes level gear 43*b* of the third intermediate gear 43 to transmit a driving torque while changing the direction of the axis of rotation by 90 degrees.

Auxiliary rollers 93 capable of rotating in contact with the discharge roller 91 receive contacting forces from plate springs 94 provided on the lower guide member 85.

A sensor 95 detects the recording sheet 3 discharged into the gap between the upper and lower guide members 84, 85 and is attached to the lower guide member 85.

A tray 96 is provided in which recording sheets 3 are placed. A switch 97 detects whether the tray 96 is set in the recording apparatus. A sensor 98 detects whether there is any recording sheet 3, to detect whether recording sheets 3 are supplied in a superposed state, and to discriminate the type of sheet.

Figure 10:
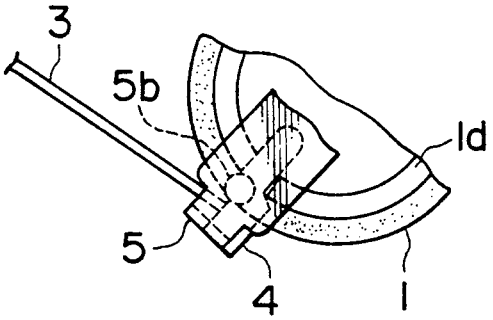
FIG. 10 is a partial enlarged view of the recording apparatus shown in FIG. 9, illustrating a part of the platen roller.

To perform printing operation, the ink sheet cartridge 73 and the recording sheet tray shown in FIG. 9 are first set in the recording apparatus, and switches 77, 78, and 97 respectively send load completion signals to the control circuit (not shown), thereby setting the recording apparatus in a waiting state. Then, a printing button (not shown) is pressed, the second motor 44 (FIGS. 5 and 7) rotates the cam gear 47 through the speed reduction gear 46. When the changeover switch 48 is changed over to the position corresponding to a sheet supply mode, the motor 44 is stopped. By this operation, the arm 51 (FIG. 7) is rotated in a counterclockwise direction to move the slider 54. With the movement of the slider 54, the supply-side reel base 23 is fixed by the ratchet member 23*a* and the lock arm 26, the platen roller is fixed by the engagement between the large gear 8*a* of the platen gear and the platen lock arm 58 to be prevented from rotating when the recording sheet 3 contacts the stopper 4. Also, the changeover arm 55 is moved in the direction of the arrow shown in FIG. 8 to move the slide gear 25 to the position indicated by the broken line, the large gear 25*a* is thereby brought into engagement with the second intermediate gear 32, while the small gear 25*b* does not engage with any gear. The platen roller rotation transmission line is therefore cut off. Also, with the movement of the slider 54, the sheet discharge swinging arm 103 is rotated in the direction of the arrow B, the swinging arms 86 and 87 shown in FIG. 5 are rotated to the positions indicated by the broken lines by the urging force of the arm spring 88, and the K arm 60 is rotated to contact the chuck arm 5 at its end 60*a*, thereby lifting the chuck arm 5 from the outer periphery of the platen roller 1. The recording sheet 3 in the tray 96 is pressed against the pickup roller 34 by the operation interlocked with the slider 54 only when the sheet supply mode is selected, although this mechanism is not specifically shown. With the sheet supply state thus established, the motor 9 is rotated to transport the recording sheet 3 to the gap between the outer circumference of the platen roller 1 and the chuck arm 5 and to bring the recording sheet 3 into contact with the stoppers 4, thereby positioning the recording sheet 3 relative to the platen roller 1. This state of the apparatus is shown in FIG. 9. FIG. 10 shows details of the chuck arm 5 and the recording sheet 3 in the corresponding state.

The control circuit (not shown) for the motor 9 may be driven according to the time between the moment at which the sensor 102 detects the recording sheet 3 and the moment at which the recording sheet 3 contacts the stopper 4, thereby readily effecting discrimination of whether the recording sheet 3 is in contact with the stoppers 4.

When the recording sheet 3 is brought into contact with the stoppers 4, the motor is stopped and the second motor 44 is then rotated for change from the sheet supply mode to an ink sheet initialization mode as in the above.

The slider 54 is moved by this operation to the right as viewed in FIG. 7. For the ink sheet initialization mode, the lock arm 26 is rotated to release the supply reel base 23 from the fixed state, the platen roller is maintained in the fixed state as in the case of the sheet supply mode, the slide gear 25 is maintained in the same state, and the sheet discharge swinging arm 103 is released from the contact with the slider 54 to be rotated in the direction C shown in FIG. 7, because the urging force of the torsion spring 99 prevails over the force of the arm spring 88, thereby rotating the swinging arms 86 and 87 to the positions indicated by the dot-dash lines in FIG. 5. Also, the K arm 60 is rotated to the position at which it does not contact the chuck arm 5, thereby enabling the recording sheet 3 to be fixed on the outer peripheral surface of the platen roller 1 with the chuck arm 5. Further, the drive arm 64 is rotated by the second groove of the cam gear 47 to move the thermal head 101 downwardly to the position indicated by the broken line in FIG. 7.

An ink sheet initialization mode state is thus established, and the motor 9 is rotated in this state. The ink sheet 76 is thereby wound around the take-up reel 74 because the slip torque of the ink sheet type-up reel base 22 is greater than the braking torque of the ink sheet supply reel base 23.

During this take-up operation, light from the light emitting element 71 is received by the light receiving element 72 through the ink sheet 76 to detect the boundary between the yellow ink and the cyan ink having different transmission factors, thereby heading the ink sheet for the first color, i.e., yellow.

After heading, the motor 9 is stopped and the second motor 47 is then rotated to change the slider 54 for a change from the ink sheet initialization mode to a recording sheet transport mode as in the above. In the recording sheet transport mode, the supply reel base 23 is fixed by the lock arm 26, the large gear 8*a* of the platen gear is released from the state in which it is fixed to the platen lock arm 58, and the large gear 25*a* of the slide gear 15 meshes with the small gear 8*b* of the platen gear and the second intermediate gear according to the relationship between the portion 54*d* of the slider 54 in contact with the changeover arm 55 and the spring 28, while the small gear 25*b* does not mesh with any gear. The sheet discharge swinging arm 103, the K arm 60 and the thermal head 101 are in the same positions as the ink sheet initialization mode.

A recording sheet transport mode state is thus established, and the motor 9 is rotated in this state. The platen roller 1 is thereby rotated while the recording sheet 3 is fixed by the chuck arm 5. When the sensor 80 detects the detection portion (not shown) of the platen gear 8, the motor 9 is stopped and the second motor 44 is then rotated to move the slider 54 for a change from the recording sheet transport mode to a printing mode as described above. In the printing mode, the supply reel base 23 is released from the fixed state, the platen lock arm 58 is released as in the case of the recording sheet transport mode, and the slide gear 35 is moved to the position indicated in FIG. 8 according to the relationship between indicated in FIG. 8 due to the relationship between the portion 54*d* of the slider 54 in contact with the changeover arm 55 and the spring 28, so that the small gear 25*b* meshes with the large gear 8*a* of the platen gear and the large gear 37*a* of the feed gear, while the large gear 25*a* does not mesh with any gear. The sheet discharge swinging arm 103 and the K arm 60 are in the same positions as the recording sheet transport mode.

The drive arm 64 is rotated by the second groove of the cam gear 47 to press the thermal head 101 against the platen roller 1 with the ink sheet 76 and the recording sheet 3 interposed therebetween in a superposed state.

Figure 12:
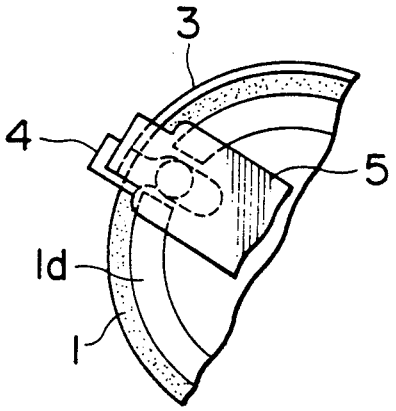
FIG. 12 is a partial enlarged view of the recording apparatus shown in FIG. 11, illustrating a part of the platen roller.
Figure 11:
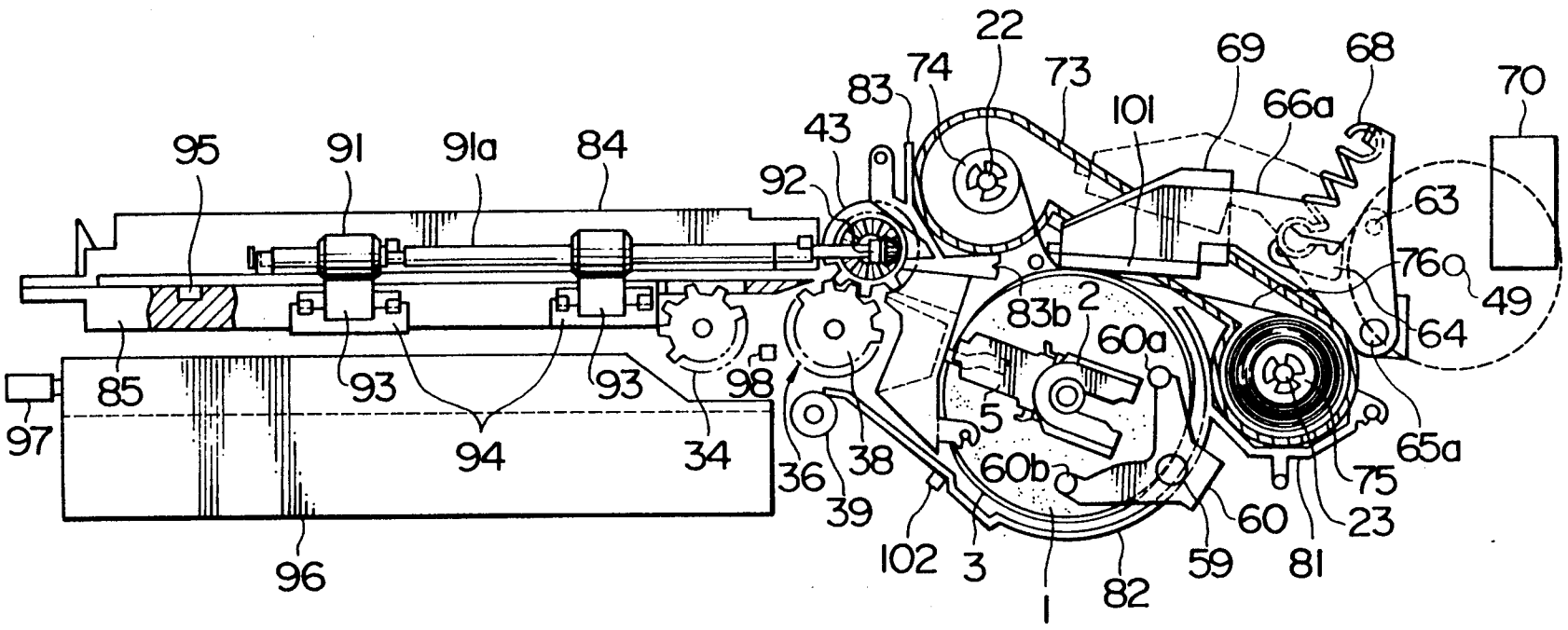
FIG. 11 is a front view of the recording apparatus shown in FIG. 5, illustrating a printing state.

A printing mode state is thus established and the motor 9 is rotated in this state. Simultaneously, the thermal head 101 is energized by the control circuit (not shown) to perform printing, and the recording apparatus is set in a state as shown in FIG. 11. Details of the recording sheet 3 and the chuck arm 5 in the corresponding state are shown in FIG. 12. It is assumed here that the timing of energization of the thermal head 101 is synchronized with the extent of driving of the platen roller 1 based on detecting the position of the slit plate 11 fixed to the rotary shaft of the motor 9 with the sensor 13.

During this operation, the ink sheet 76 and the recording sheet 3 are integrally transported by the platen roller 1, and the used portion of the ink sheet is separated from the recording sheet 3 at the top end of the thermal head 101 and is wound around the take-up reel 74 by the take-up reel base 22. The braking torque of the slip mechanism of the supply reel base 23 is applied to the ink sheet 76 as a back tension, thereby preventing the ink sheet 76 from creasing. On the other hand, the recording sheet 3 is guided by the guide members 81, 82, and 83 so as to move along the platen roller 1.

After a predetermined amount of printing of the first color (yellow) has been completed, the energization of the thermal head 101 is stopped, but transportation of the recording sheet 3 and the ink sheet 76 under the pressure of the thermal head 101 is continued. During this continuation, heading for the second color (magenta) is effected and the printed recording paper 3 and the ink sheet 76 are separated from each other. After these two operations have been finished, the second motor is rotated while the motor 9 is stopped. The operational mode is thereby changed from the printing mode to the recording sheet transport mode as in the above. Subsequently, the second color (magenta) and the third color (cyan) are printed in the same manner as above. After printing of the third color has been finished, the platen roller 1 is rotated in the recording sheet transport mode, the motor 9 is stopped based on the operation of the sensor 80 as in the above, and the second motor 44 is rotated to move the slider 54 for change from the recording sheet transport mode to a recording sheet discharge mode as in the above. In the recording sheet discharge mode, the supply reel base 23 is fixed by the lock arm 26, the platen lock arm 58 is released as in the case of the recording sheet transport mode, and the slide gear 25 meshes with the platen gear 8 in the same manner as the printing mode. The K arm 60 is rotated by the hole 54*f* of the slider 54 so as to contact the chuck arm 5 as its end 60*b*, thereby lifting the chuck arm 5 from the outer circumference of the platen roller 1. The recording sheet 3 is thereby released from the fixed state.

At this time, the projections 5*b* of the chuck arm 5 come off the cut-out portions 1*b* of the platen roller 1 and move to the position corresponding to the outer circumference of the projecting ribs 1*d* of the platen roller 1.

The sheet discharge swinging arm 103 and the thermal head 101 are maintained in the same positions as the printing mode.

Figure 14:
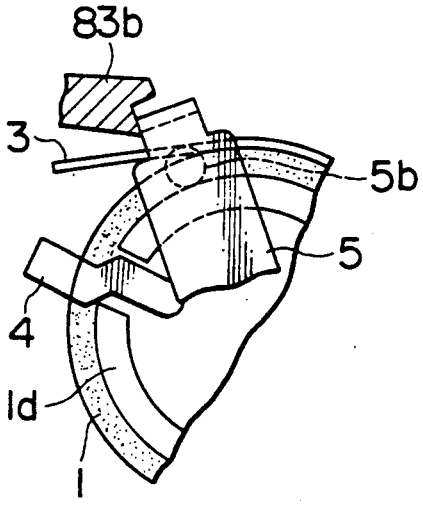
FIG. 14 is a partial enlarged view of the recording apparatus shown in FIG. 13, illustrating a part of the platen roller.
Figure 13:
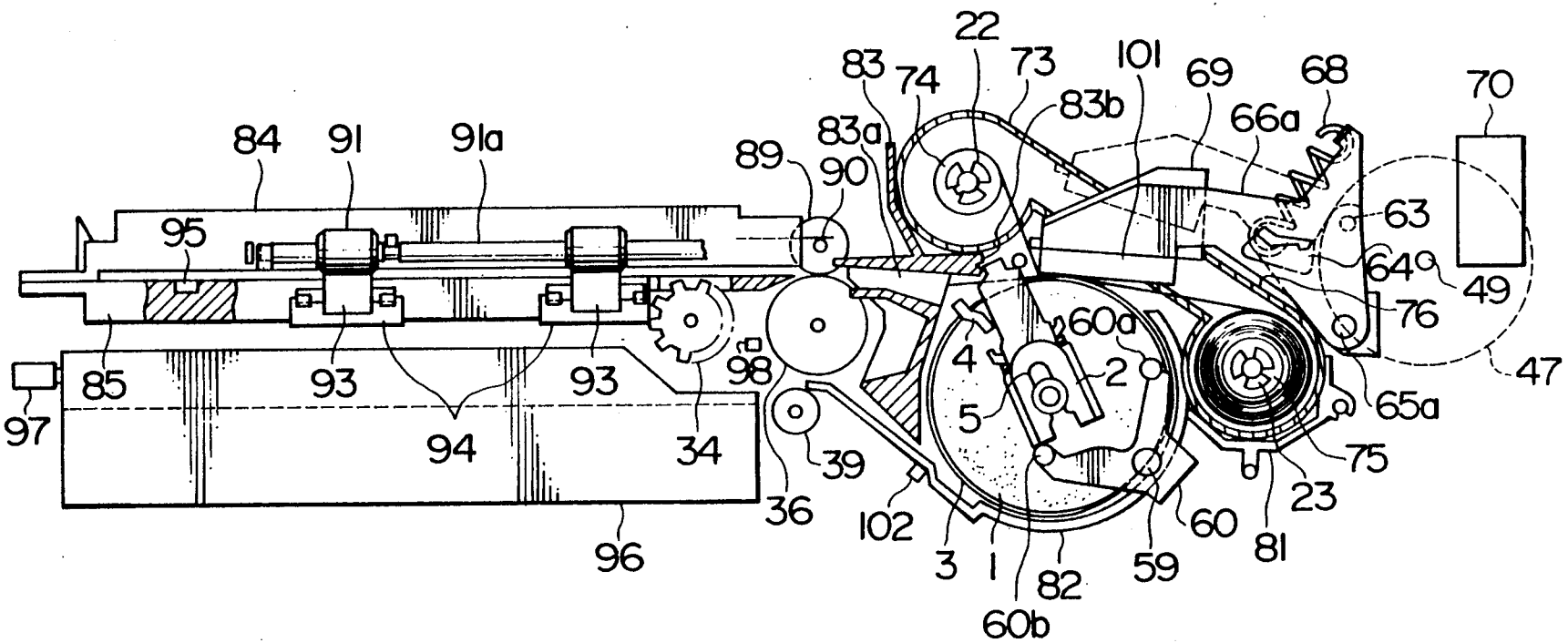
FIG. 13 is a front view of the recording apparatus shown in FIG. 5, illustrating a discharging state.
Figure 15:
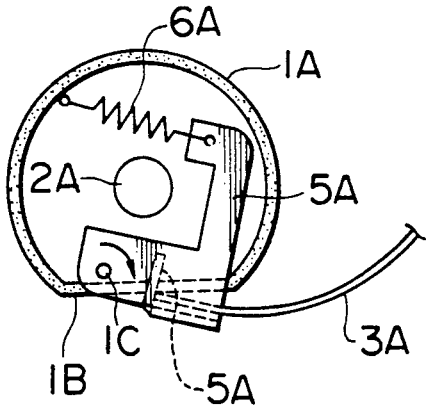
FIG. 15 PRIOR ART
FIGS. 15 to 17 are side views of a conventional platen roller.
Figure 16:
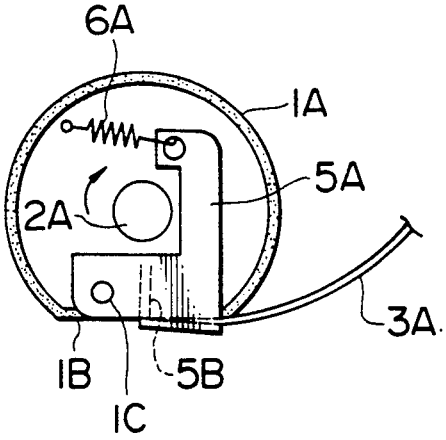
FIG. 16 PRIOR ART
Figure 17:
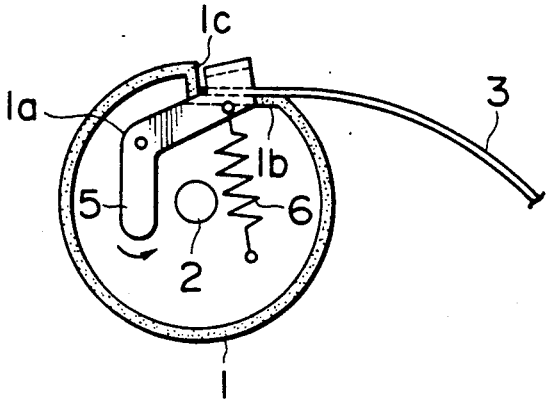
FIG. 17 PRIOR ART

The recording sheet discharge mode is thus established and the motor 9 is thereafter rotated. The chuck arm 5 thereby engages with the engagement portion 83*b* of the take-up-side guide member 83. The projections 5*b* of the chuck arm 5 therefore contact the outer circumferential surface of the projecting ribs 1*d* of the platen roller 1 to constantly maintain the gap between the platen roller 1 and the chuck arm 5, while the recording sheet 3 is transported to the discharge opening 83*a* of the take-up-side guide member by the pressing force of the thermal head 101, with FIG. 13 shows this state. FIG. 14 showing details of the recording sheet 3 and the chuck arm 5 in the corresponding state.

Further, the motor 9 is rotated until the recording sheet 3 contacts the central rubber roller member 36*b* of the feed roller 36 to be nipped between the roller member 36*b* and the roller 89 rotating in contact with this roller member. At this time, the position of the recording sheet 3 can be easily detected through the drive circuit (not shown) based on the detection of rotation of the slit plate 11 using the sensor 13. During this operation, the ink sheet 76 can be transported with the transportation of the recording sheet 3. However, the length of the portion of the third color is determined such that the next portion of the first color does not yet appear.

Next, the second motor 44 is rotated for a change from the recording sheet discharge mode to the recording sheet transport mode while moving the slider 54 in the same manner as the recording sheet transport mode. The motor 9 is rotated in this state to transport the recording sheet 3 by the central rubber roller member 36*b* of the feed roller and the roller 89 and to discharge the sheet into the gap between the upper and lower guide members 84 and 85. Since at this time the swinging arms 86 and 87 are in the positions indicated by the dot-dash lines in FIG. 5, they do not contact the recording sheet 3. When the platen roller 1 makes one round, the projections 5*b* of the chuck arm 5 fitted in the cut-out portions of the platen roller 1 by the urging force of the springs 6, and the chuck arm 5 is thereby pressed against the platen roller 1.

The motor 9 is stopped a certain time after the moment at which the recording sheet 3 is detected by the sensor 95. At this time, the rear end of the recording sheet 3 is completely discharged into the gap between the upper and lower guide members, and the platen roller 1 is stopped at the position for the sheet supply mode based on the detection of the detection point on the platen gear 8 with the sensor 79.

The second motor 44 is then rotated to move the slider 54 for a change from the recording sheet transport mode to a waiting mode as in the above. In the waiting mode, the supply reel base 23 is fixed by the lock arm 26, the platen roller 1 is fixed by the platen lock arm 58, and the slide gear 25 is moved to the same position as the sheet supply mode. i.e., the position indicated by the broken line in FIG. 8. Also, the K arm 60 is moved as in the case of the recording sheet transport mode, and the thermal head 101 is lifted to the position indicated in FIG. 9. The sheet discharge swinging arm 103 is brought into contact with the slider 54 and is thereby rotated in the direction B shown in FIG. 7, thereby rotating the swinging arms 86 and 87 to the positions indicated by the broken lines in FIG. 5, as in the case of the ink sheet initialization mode. The recording sheet 3 between the upper and lower guide members 84 and 85 is pressed against the discharge roller 91 by the swinging arms 86 and 87.

The waiting mode is thus established and the motor 9 is thereafter rotated to transport and discharge the recording sheet 3 out of the apparatus by the discharge roller 91 and the auxiliary rollers 93. The motor 9 is stopped a certain time after the moment at which the sensor 95 detects that the recording sheet 3 is completely discharged, thereby completing the overall operation.

What is claimed is:

1. A platen roller apparatus comprising:

a cylindrical platen roller having a smooth uninterrupted outer peripheral surface for receiving a recording sheet;

a recording sheet retaining means for retaining the sheet on said platen roller;

means for mounting said sheet retaining means so as to be movable with respect to said platen roller while being maintained in a parallel relationship with respect to a longitudinal center axis of the platen roller;

positioning means engageable with a leading edge of the recording sheet on the uninterrupted outer peripheral surface of the platen roller for positioning the leading edge of the recording sheet in a circumferential direction of said platen roller; and means for urging said recording sheet retaining member inwardly in a radial direction of said platen roller, whereby the recording sheet, positioned by said positioning means, is pinched between said smooth uninterrupted outer peripheral surface of said platen roller and said recording sheet retaining member so as to be retained between said recording sheet retaining member and said smooth uninterrupted outer peripheral surface of said cylindrical platen roller.

2. A platen roller apparatus according to claim 1, wherein said positioning means includes a positioning member attached to opposite side portions of said platen roller.

* * * * *